United States Patent [19]

Hartwig

[11] 4,367,075

[45] Jan. 4, 1983

[54] PRESSURIZED ROTARY KILN WITH THRUST CONTAINMENT

[75] Inventor: Walter J. Hartwig, Watertown, Wis.

[73] Assignee: Allis-Chalmers Corporation, Milwaukee, Wis.

[21] Appl. No.: 321,748

[22] Filed: Nov. 16, 1981

[51] Int. Cl.[3] ..... C10B 1/10

[52] U.S. Cl. ..... 48/89; 34/242; 48/101; 202/131; 202/268; 202/269; 422/209; 432/115

[58] Field of Search ..... 202/100, 268, 131, 136, 202/249, 216, 218, 269; 34/108, 242; 432/124, 115; 48/210, 77, 122, 85.1, 89, 101, 99; 422/209

[56] References Cited

U.S. PATENT DOCUMENTS

| | | | |
|---|---|---|---|
| 1,582,297 | 4/1926 | Neumaier | 202/131 |
| 3,193,266 | 7/1965 | Becker | 432/115 |
| 3,990,865 | 11/1976 | Cybriwsky et al. | 48/197 R |
| 4,087,334 | 5/1978 | Harig et al. | 202/269 |
| 4,193,756 | 3/1980 | Leon | 432/115 |
| 4,295,824 | 10/1981 | Wens | 432/115 |

OTHER PUBLICATIONS

*Illustrated Technical Dictionary* vol. III, p. 303, Brentano's Publisher 1908.

*Diesel Engineering Handbook*, p. 322, L. H. Morrison editor 1939.

*Primary Examiner*—Peter F. Kratz
*Assistant Examiner*—Michael Goldman
*Attorney, Agent, or Firm*—Timothy R. Conrad

[57] ABSTRACT

A thrust containment apparatus is disclosed for use with a pressurized rotary kiln gasifier. The thrust containment apparatus maintains stationary hoods mounted on both ends of the kiln shell in fixed positions by relieving the hoods of forces generated by high pressures within the kiln. The thrust containment device comprises braces mounted on the hoods on the sides remote from the kiln shell. Tie members, or tie rods, extending along the exterior of the kiln shell connect the braces. An expandable bellows is provided between one brace and its adjacent hood. As tie members deform through thermal and tensile expansion, the bellows accomodates the expansion while maintaining a gas-tight seal between the hood and the brace. Being of equal internal pressure as the kiln and having a diameter against the hood equal to the diameter of the seal connecting the hood to the kiln, the bellows relieves the hoods of all pressure forces and transmits these forces to the braces and tie rods thereby ensuring continuous stationary positioning of the hoods.

4 Claims, 4 Drawing Figures

PRESSURIZED ROTARY KILN WITH THRUST CONTAINMENT

BACKGROUND OF THE INVENTION

1. Field of the Invention

This invention relates to rotary kilns for the gasification of solid carbonaceous material such as described in copending patent application of P. G. Garside, Ser. No. 264,479 filed May 18, 1981, and U.S. Pat. No. 3,990,865 to Cybriwsky and Petersen dated Nov. 9, 1976. Particularly, this invention is directed toward a thrust containment device for maintaining kiln hoods in a stationary position during thermal expansion of kiln apparatus and while the kiln is operating at relatively high pressures.

2. Description of the Prior Art

As disclosed in the aforesaid copending patent application of P. G. Garside and U.S. Pat. No. 3,990,865, the gasification of coal can be attained in a pressurized rotary kiln. Such a kiln is equipped with stationary hoods at both ends of the kiln with seals connecting the hoods to the kiln shell. The seals may be of a type as disclosed in U.S. Pat. No. 4,087,334 to Harig et al dated May 2, 1978 so as to allow rotary motion of the kiln shell and accommodate axial and radial thermal expansion of the kiln shell while maintaining a gas-tight seal.

Rotary kilns for the commercial production of gas from coal are quite lengthy being of 250 feet or more in length and 12 feet or more in diameter. Additionally, such kilns operate at temperatures exceeding 2,000° F. and pressures of up to 180 pounds per square inch greater than atmospheric pressure. Consequently, such kilns produce tremendous forces acting upon the hoods and seals of the kiln. Indeed, for a kiln operating at 75 pounds per square inch of pressure higher than ambient atmospheric pressure and having a seal diameter of 12 feet, axial forces acting upon the kiln hoods exceed 900,000 pounds.

These forces tend to urge the hoods out of alignment with the kiln shell resulting in undesirable displacement and reduction of kiln seal efficiencies. Indeed, I have determined that for a kiln with a seal diameter of ten feet, an angular displacement of as small as 1/32 inch is intolerable.

It has been suggested to maintain the kiln hoods in a stationary position by mounting them upon concrete foundations. However, the length of the kiln, the forces acting upon the hoods, and the slim tolerances permitted make traditional concrete foundations ineffective in most locations due to inadequate subsoil stability.

I have determined that tie members, or tie rods, connecting braces mounted upon the kiln hoods can be successfully employed to maintain kiln hoods in stationary positions during the kiln operation.

The use of tie members to relieve stresses resulting from pressure forces within a vessel are well known. For example, *Illustrated Technical Dictionary,* Vol. III, page 303, Brentano's Publishers, New York, New York (1908), illustrates the use of a tie rod to relieve stress between a steam boiler's walls. Also, *Diesel Engineering Handbook,* page 322, L. H. Morrison, Ed. (1939), illustrates the use of tie rods to secure cylinder heads in diesel engines. Tie rods are also known to have been used in constructing bridges and buildings.

However, the use of tie rods or tie members to control forces in a pressurized rotary kiln has, to my knowledge, never been attempted. Additionally, a tie rod assembly for such rotary kilns, due to a combination of the extreme length of the rods (e.g. 260 feet) and the extreme temperatures involved (e.g. 2,200° F.), is prone to substantial thermal expansion. Also, the axial forces resulting from pressure inside the kiln (amounting to over 900,000 pounds) contribute to the expansion by reason of resulting tensile forces. Therefore, a tie rod assembly must overcome an expansion problem of unique magnitude not heretofore faced in applying tie rods to boilers, engines, bridges and buildings.

I have found this problem can be eliminated by providing the tie members with an expansion device, such as a bellows, to accommodate the expansion of the tie members while transmitting all pressure forces from the hoods to the tie members.

The object of the present invention is to provide a thrust containment device for a pressurized rotary kiln coal gasifier, to relieve forces from the kiln hood and seals.

It is a further object of the present invention to provide a thrust containment device for a pressurized rotary kiln gasifier employing tie members rigidly fixed to braces on either end of the kiln with an expansion means provided to accommodate thermal and tensile expansion of the tie members.

SUMMARY OF THE INVENTION

According to a preferred embodiment of the present invention, there is provided a thrust containment apparatus to maintain positioning of stationary hoods enclosing ends of a pressurized rotary kiln used in the gasification of coal or other solid carbonaceous material. The rotary kiln comprises a generally horizontal cylindrical kiln shell rotating between two stationary hoods, with one enclosing each end of the kiln shell. As the kiln shell heats up during operation, axial and radial thermal expansion of the shell is accommodated by seals mounted upon the hoods and engaging the kiln.

Disrupting forces acting against the hoods, caused by pressure within the kiln, are relieved through tie members extending along the exterior of the kiln and joined by braces mounted on each end of the kiln. An expansion device, such as a bellows or the like, is provided between one brace and its adjacent hood. As the tie members expand due to thermal and tensile forces, the bellows accommodates the expansion. Pressure within the bellows is maintained identical to pressure within the kiln. The bellows is of like diameter as the kiln seal on the hood adjacent the bellows, thereby insuring a balancing and neutralizing of forces on the hood due to pressure within the kiln and the complete transfer of forces to the braces and tie members.

DESCRIPTION OF THE PREFERRED EMBODIMENT

Figure 2:
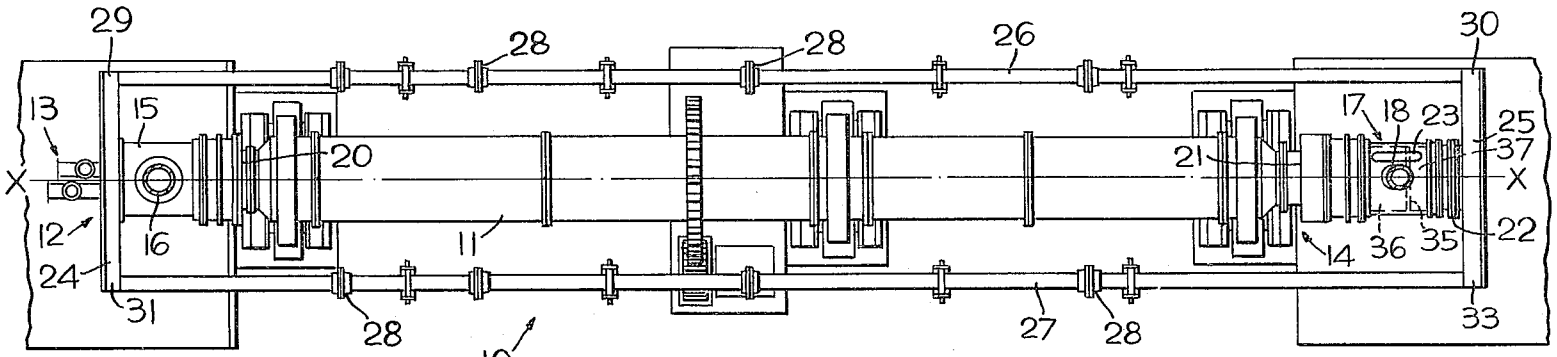
FIG. 2 shows a top view of the kiln shown in FIG. 1.
Figure 1:
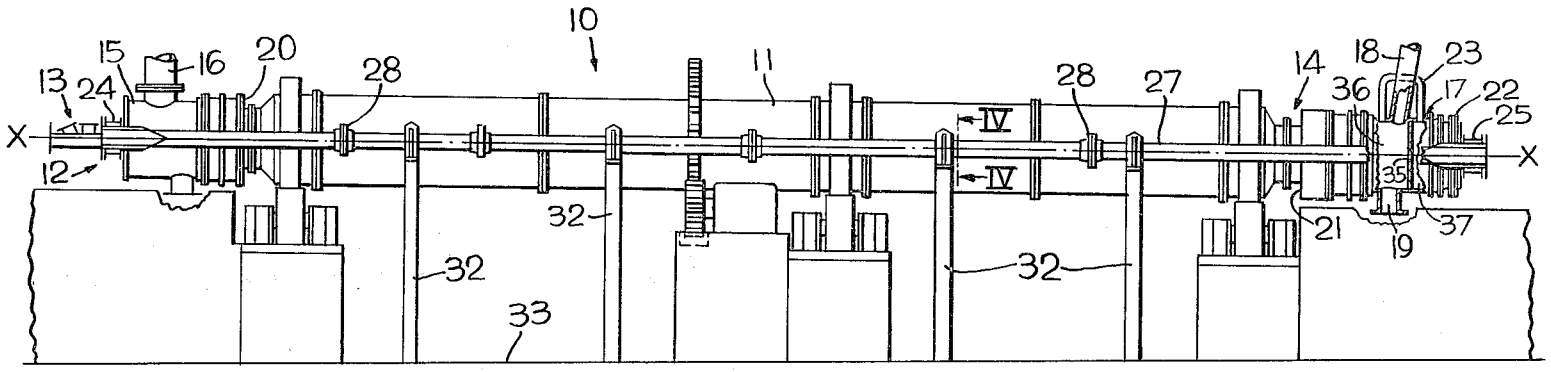
FIG. 1 shows a side view, partially cut away, of a rotary kiln including the present invention.
Figure 3:
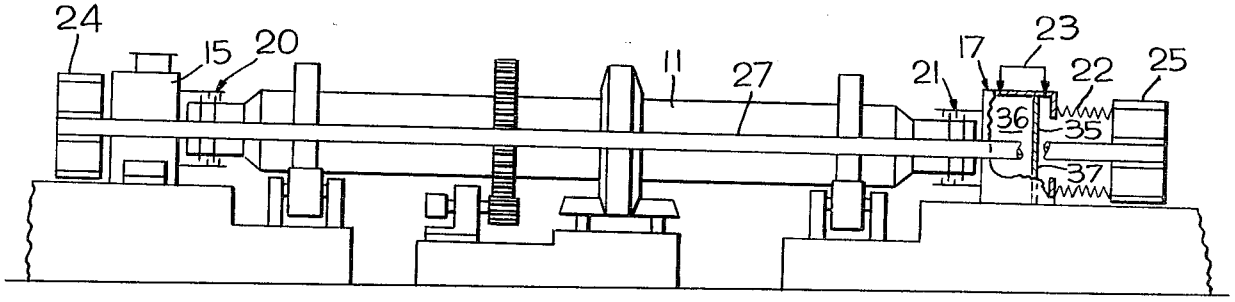
FIG. 3 is a schematic showing of a rotary kiln including the present invention.
Figure 4:
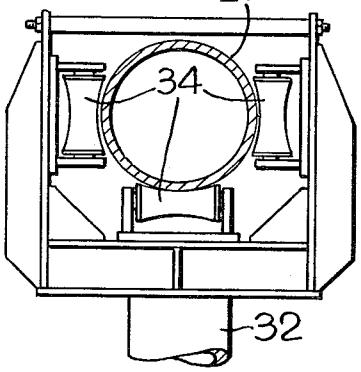
FIG. 4 is a cross section view taken on line IV—IV of FIG. 1 showing a roller support.

Referring to FIGS. 1 and 2, a rotary kiln for the gasification of solid carbonaceous material is shown herein generally at 10. The kiln 10 includes a cylindrical kiln shell 11 having a generally horizontal axis X—X.

Coal or other carbonaceous material is fed from a delivery conduit (not shown) into a material feed end 12 of the kiln shell 11 through a feeder 13. Means for delivering coal or other solid material to a pressurized kiln (as will hereinafter be described) form no part of this invention and are more fully described in U.S. Pat. No. 4,244,705 to Seidl et al dated Jan. 13, 1981. Conventional means well known in the art may be provided to rotate the kiln shell 11. The kiln shell 11 is inclined downwardly from the material feed end 12 to a material discharge end 14. This inclination, together with the rotary action of the kiln shell 11, causes the coal to form a bed (not shown) within the kiln shell 11 that slowly moves down the incline as it is gasified. It will be appreciated that the process for the gasification of coal forms no part of this invention and may be as is more fully described in the aforesaid U.S. Pat. No. 3,990,865 to Cybriwsky and Petersen dated Nov. 9, 1976 and copending patent application Ser. No. 264,479 of P. G. Garside. The kiln shell 11 may be ported as shown in the aforesaid patent and application.

The material feed end 12 of the kiln shell 11 is provided with a stationary feed hood 15 having a gas outlet conduit 16. The material discharge end 14 of the kiln shell 11 is provided with a stationary discharge hood 17. The discharge hood 17 has a gas outlet conduit 18 and an ash outlet passage 19. A fuel burner (not shown) is provided in the discharge hood 17 to preheat the kiln and the coal to operating temperature during start-up.

Seals 20, 21 are provided at the material feed end 12 and discharge end 14 of kiln shell 11, respectively, connecting the feed hood 15 and discharge hood 17 to kiln shell 11. Said seals 20, 21 (of suitable construction and design to permit radial and axial expansion and contraction of kiln shell 11 while maintaining a gas-tight seal between kiln shell 11 and stationary hoods 12, 14) form no part of this invention and may be of the type shown in U.S. Pat. No. 4,087,334 to Harig et al dated May 2, 1978.

An expansion bellows 22 is provided affixed to the discharge hood 17 on an end thereof remote from said kiln shell 11. Said bellows 22 is of a generally cylindrical shape and is positioned upon said discharge hood 17 so as to be coaxial with the axis X—X of kiln shell 11. Said bellows 22 is further constructed so as to have a diameter equal to the inside diameter of seal 21 adjacent to discharge hood 17.

As shown in FIG. 1, a dividing wall 35 is provided within discharge hood 17. Dividing wall 35 divides discharge hood 17 into a first chamber 36 communicating with gas outlet conduit 18, ash outlet conduit 19, and the interior of the kiln, and a second chamber 37 communicating with the interior of bellows 22. A bypass conduit 23 is provided extending from said first chamber 36 to said second chamber 37.

A feed end brace 24 (FIGS. 1 and 2) is provided affixed to the feed hood 15 on a side thereof remote from kiln shell 11. Feed end brace 24 is constructed of suitable material such as steel, or the like, in a generally rectangular shape. Feed end brace 24 is positioned upon feed hood 15 in a plane perpendicular to axis X—X of kiln shell 11. A discharge end brace 25, of similar construction as feed end brace 24, is positioned upon discharge hood 17 on a side thereof remote from bellows 22 and disposed in a plane perpendicular to axis X—X of kiln shell 11.

Feed end brace 24 and discharge end brace 25 are connected to one another by tie members 26, 27 (FIG. 2). Each tie member is constructed of suitable metal piping (such as 16 inch steel pipe or the like) connected by flange joints as at 28. The first tie member 26 extends along one side of kiln shell 11 running parallel to axis X—X of kiln shell 11. First tie member 26 together with kiln axis X—X define a plane which is generally horizontal. First tie member 26 is affixed to the feed end brace 24 on one end 29 thereof and, likewise, affixed to the discharge end brace 25 at one end 30 thereof.

A second tie member 27 is affixed to the feed end brace 24 on an end 31 thereof remote from the first tie member 26 and, likewise, is affixed to the discharge end brace 25 at an end 33 thereof remote from the first tie member 26. Second tie member 27 is coplanar with tie member 26 and kiln axis X—X and is of like distance from kiln axis X—X as the first tie member 26.

A plurality of vertical support posts 32 are spaced along each of said tie members 26, 27 (FIG. 1). Each support post 32 is rigidly secured to a stationary surface 33 on an end thereof remote from said tie members 26, 27. Suitable means 34, such as rollers or the like, are provided on an end of said post 32 adjacent said tie members 26, 27.

OPERATION

With the construction of kiln 10 as described, a burner (not shown) in discharge hood 17 is ignited to preheat the kiln shell 11, hoods 15, 17 and gas outlet conduits 16, 18. As more fully described in the aforesaid copending application of P. G. Garside, Ser. No. 264,479, the kiln shell is heated to a temperature of between 1,500° to 1,800° F. before coal is fed through feeder 13 into kiln shell 11. As the kiln 11 is preheating, the pressure within kiln shell 11 is the same as ambient atmospheric pressure.

During the preheating of kiln shell 11, the shell 11 experiences both axial and radial thermal expansion. This expansion is accommodated by seals 20, 21 allowing continuous stationary positioning of hoods 15, 17. Additionally, as the kiln 11 is preheated, tie members 26, 27 expand thermally. Rollers **33*a* upon posts 32 supporting tie members 26, 27 permit uninhibited expansion of tie members 26, 27. The expansion of tie members 26, 27 is accommodated by bellows 22 permitting continuous stationary positioning of hoods 15, 17 while maintaining a gas-tight enclosure between discharge end brace 25 and discharge hood 17**.

After the kiln shell 11 is preheated and the kiln is partially filled with a bed of coal, the burner is turned off and air and steam injection is begun through ports (not shown) in the kiln shell 11. The ports for delivering air and steam to kiln shell 11 and means for controlling the delivery of air and steam form no part of this invention and may be as is more fully described in the aforesaid Garside patent application and U.S. patents to E. F. Rossi U.S. Pat. No. 3,847,538 of Nov. 12, 1974; U.S. Pat. No. 3,945,624 of Mar. 23, 1976; U.S. Pat. No. 4,070,149 of Jan. 24, 1978; U.S. Pat. No. 3,661,370 of May 9, 1972 and U.S. Pat. No. 4,214,707 to J. W. Flaherty dated July 29, 1980.

Steam and air pressures into the kiln 10 are adjusted to provide a gas pressure within the kiln from 60 to 180 pounds per square inch higher than ambient atmospheric pressure. Additionally, as air and steam is admitted to kiln 10, the temperature within the kiln rapidly rises to 1,600° to 2,200° F. As a result of the increase in temperature, the kiln continues to expand both axially and radially with said expansion accommodated by seal 20, 21 mounted upon hoods 15, 17.

Bypass conduit 23 connecting first chamber 36 with second chamber 37 within discharge hood 17 permits the flow of the pressurized gas from the kiln 10 into bellows 22 acting against discharge end brace 25, and tie members 26, 27 expand under tension as well as expanding thermally due to the increase in temperature to 1,600° to 2,200° F. Both the thermal and tensile expansion of tie members 26, 27 are accommodated by bellows 22 until the tie members attain a position of equalibrium during operation of the gasifier. Bellows 22 within discharge hood 17, being of like diameter of seal 21 mounted upon hood 17, permits gas pressure within bellows 22 to act with equal force upon discharge hood 17 as forces within kiln 10. Additionally, gas pressure within bellows 22 allows all forces from the gas pressure to act upon braces 24, 25 and tie members 26, 27 while relieving hoods 15, 17 of disturbing forces thereby maintaining hoods in the desired stationary position.

When the gasifying operation is discontinued, the pressure and temperature of the kiln and the temperature of the tie members 26, 27 return to ambient atmospheric temperature and pressure. The radial and axial contraction of kiln shell 11 is accommodated by seals 20, 21 and the contraction of tie members 26, 27 is accommodated by bellows 22 thereby maintaining hoods 15, 17 in the desired stationary position.

From the foregoing detailed description of the present invention, it has been shown how the objects of the invention have been attained in a preferred manner. However, modification and equivalents of the disclosed concepts such as readily occur to those skilled in the art are intended to be included in the scope of this invention. Thus, the scope of the invention is intended to be limited only by the scope of the claims as are, or may hereafter be, appended hereto.

The embodiments of the invention in which an exclusive property or privilege is claimed are defined as follows:

1. A rotary kiln apparatus for the gasification of solid carbonaceous material; said kiln having a cylindrical kiln shell with a central axis being inclined downwardly from a material feed end of said kiln shell to a material discharge end; means to feed the solid carbonaceous material to said material feed end; a nonrotary feed hood having a gas outlet and engaging said material feed end; and a nonrotary discharge hood, having gas and ash outlets, and engaging said material discharge end; the improvement comprising:

a. a feed end brace adjacent to said nonrotary feed hood on an end thereof remote from said kiln shell; said feed end brace disposed in a plane generally perpendicular to said axis of said kiln shell;

b. expansion means adjacent said discharge hood on an end thereof remote from said kiln shell; said expansion means permitting expansion along the axis of said kiln shell;

c. a discharge end brace adjacent said expansion means on an end thereof remote from said discharge hood; said discharge end brace disposed in a plane generally perpendicular to said axis of said kiln shell;

d. rigid means for connecting said feed end brace with said discharge end brace;

whereby said feed end hood and said discharge hood are maintained in fixed and stationary position against said kiln shell by said feed end brace and said discharge end brace; said end braces relieve forces on said hoods by transmitting said forces to said connecting means and with said expansion means permitting expansion of said rigid connecting means while maintaining gas-tight connection between said discharge hood and said discharge end brace.

2. A further improvement to a rotary kiln according to claim 1 wherein said expansion means includes a generally cylindrical bellows permitting expansion and contraction along the axis of said kiln shell; and means for maintaining pressure within said bellows identical to pressure within said kiln shell against said discharge hood.

3. A further improvement to a rotary kiln according to claim 2 wherein said means for maintaining pressure within said bellows identical to pressure within said kiln shell against said discharge hood includes a dividing wall with said discharge hood to define a first chamber within said discharge hood adjacent said kiln and a second chamber within said discharge hood adjacent said bellows; a bypass conduit extending from said first chamber to said second chamber.

4. A further improvement to a rotary kiln according to claim 1 wherein said connecting means includes a first tie member affixed to said feed end brace; said tie member extending to said discharge end brace along the exterior of said kiln shell; said tie member being parallel to said axis of said kiln shell; means for affixing said tie member to said discharge end brace; said connecting means also including a second tie member extending along the exterior of said kiln shell remote from said first tie member; said second tie member being parallel to said axis of said kiln shell; said axis, second tie member, and first tie member being mutually coplanar; and means for affixing said second tie member to said feed end brace and said discharge end brace.

* * * * *